US005829422A

United States Patent [19]

Deeds et al.

[11] Patent Number: 5,829,422

[45] Date of Patent: Nov. 3, 1998

[54] LIGHTWEIGHT, HIGH-POWER MAGNETO SYSTEM

[75] Inventors: Ted D. Deeds; Craig A. Holmes, both of Carson City, Nev.; Alan E. Dawson, Menlo Park, Calif.

[73] Assignee: Mallory, Inc., Carson City, Nev.

[21] Appl. No.: 892,575

[22] Filed: Jul. 16, 1997

[51] Int. Cl.[6] ..... F02P 1/00

[52] U.S. Cl. ..... 123/599

[58] Field of Search ..... 123/599, 600, 123/601, 602, 603, 604, 594, 598

[56] References Cited

U.S. PATENT DOCUMENTS

| | | | |
|---|---|---|---|
| 3,942,501 | 3/1976 | Byles | 123/599 |
| 3,955,550 | 5/1976 | Carlsson | 123/599 |
| 4,061,121 | 12/1977 | MacLeod | 123/599 |
| 4,160,435 | 7/1979 | Sleder | 123/599 |
| 4,213,436 | 7/1980 | Burson | 123/599 |
| 4,259,938 | 4/1981 | Johansson | 123/599 |
| 4,269,152 | 5/1981 | Van Siclem, Jr. | 123/599 |
| 4,620,521 | 11/1986 | Henderson et al. | 123/599 |
| 4,892,079 | 1/1990 | Umeza et al. | 123/599 |

*Primary Examiner*—Raymond A. Nelli
*Attorney, Agent, or Firm*—Oliff & Berridge, PLC

[57] ABSTRACT

A magneto ignition system for applications which require long burn times (usually measured in milliseconds), high spark energy to ignite the air/fuel mixtures used in racing applications and light weight. Such applications can use air fuel rations as low as 2:1. The magneto assembly includes a one-piece shaft having a polygonal center section with sides defining a plurality of magnet receiving surfaces. Each surface is fixedly provided with a magnet, preferably a rare earth magnet, with adjacent ones of the magnets being arranged to have alternating outwardly facing poles. A magneto housing contains an array of stator windings that surround the plurality of magnets. The housing also includes opposed apertures with bearings for receiving opposed ends of the shaft. A non-conductive retainer housing surrounds the plurality of magnets and is affixed to the shaft to counteract centrifugal forces acting on the magnets, thus retaining the magnets on the shaft. The non-conductive retainer is located between the magnets and the stator windings and minimizes eddy currents and heat buildup in the magneto assembly.

30 Claims, 10 Drawing Sheets

LIGHTWEIGHT, HIGH-POWER MAGNETO SYSTEM

BACKGROUND OF THE INVENTION

The present invention relates to magneto ignition assemblies for internal combustion engines that require increased spark energy. More particularly, the invention relates to magneto assemblies for an engine comprising a shaft having a plurality of magnets attached thereto, and a magneto housing containing an array of stator windings surrounding the plurality of magnets.

A typical application for a magneto ignition system is in drag racing. In such an application, weight is a critical factor because it takes less horsepower to propel a smaller weight than it does a larger weight. If two similar cars of different weights are running on the same dragstrip with the same amount of horsepower, the lighter car will accelerate faster than the heavier car.

Supercharged V8 drag racing engines using nitromethane fuel provide very high output, but to do so, the mixture of fuel and air is very "rich", i.e., compared to conventional gasoline mixtures used in automobile engines, there is much more fuel used for a given volume of air. In order to reliably ignite this mixture, the ignition system must be very powerful, i.e., produce a spark with high energy, in order to transfer as much heat as possible to the mixture.

A conventional battery-based ignition system would be very large to provide this necessary spark energy, both in physical volume and in weight. Additionally, known automotive magneto systems of sufficient power output are also large in size and weight.

In current designs, i.e., the established art, the clearance between the shaft assembly and the alternator winding must be very close. This is because of the low efficiency of the current designs. Magneto output drops off quickly as the clearance of the shaft/winding increases.

Also, in current designs, the magneto shaft has a woodruff key design at the end to rotate the shaft. This may be acceptable for low power application. However, such a design is not capable of transmitting large torque forces.

Further, if conventional magneto assemblies utilize an aluminum retaining ring structure, large eddy currents and high heat buildup can result.

There is a need for a magneto ignition system that can deliver more power while minimizing size and weight. Moreover, there is a need for an improved drive structure that is capable of handling the increased power and torque required for such a system. Further, there is a need for an improved retaining structure for a magneto that reduces eddy currents and heat buildup while maintaining sufficient retention of magneto components.

This invention fulfills these needs, along with other needs that will be apparent to those skilled in the art given this disclosure.

SUMMARY OF THE INVENTION

The magneto assemblies of the present invention overcome the problems with the prior magneto and battery-based ignitions since the magneto assemblies of the present invention generate very high electrical power, yet are relatively small and lightweight. This combination of high output and low weight is unique.

The invention is comprised of three major subassemblies: the generator unit, the control box, and the ignition transformer. The generator unit includes an upper housing assembly, a lower housing assembly, and a poleshoe. Each housing assembly includes a cup member and a bearing in an end wall thereof. The poleshoe includes a shaft, a plurality of magnets, and a phenolic housing. The ends of the shaft are received in the bearings of the housing assemblies. The phenolic housing consists of upper and lower endcaps and a central ring. The magnets are contained within the phenolic housing. The upper and lower housing assemblies include a multipole stator having a plurality of stator windings. These windings are adjacent the array of magnets. An LED-based triggering module in the generator unit is used for spark timing.

The poleshoe is driven at one-half crankshaft speed and timed with respect to the stator so that the electrical current from the stator winding reaches maximum amplitude just before a given spark is to occur. This alternating electrical current is rectified to direct current by the control box and shunted to chassis ground until it is time for a spark. When the LED-based timing module in the generator unit signals that it is time for a spark, the control box becomes an open circuit to the electrical current. The current is no longer rectified nor shunted to chassis ground. The magnetic field that had been formed in the stator windings by electrical current then collapses, inducing a large pulse of electrical current to the control box and the ignition transformer. Since the control box is open circuited, the pulse is forced to flow through the transformer primary winding. The transformer "steps up" the voltage according to its turns ratio, providing a high voltage pulse to the distributor rotor, which is attached to the poleshoe shaft. A conventional distributor cap then distributes the spark to the appropriate cylinder.

In the present invention, the poleshoe, phenolic housing and stator winding arrangement allows the magneto ignition to be significantly lighter than similar magneto ignition systems. Additionally, unlike other electronically triggered magneto-type ignitions, the alternating current output from the generator is not rectified by the control box to direct current at all times. Rather, it is only rectified during the dwell period of operation. This causes bipolar spark generation in which each successive spark is of the opposite polarity of the spark preceding it. This eliminates transformer core saturation and increases system efficiency. Additionally, the ignition transformer's combination of high inductance and low turn ratio combines with the alternating current output from the generator to deliver very high current pulses to the engine's spark plugs, even at very high engine speeds, without the transformer magnetic core saturation problems that occur in "normal" ignition systems, i.e., those with monopolar spark generation.

The following is an overview of the system's operation:

GENERATOR CONSTRUCTION AND OPERATION

The preferred generator poleshoe consists of a steel shaft, an array of magnets mounted on the shaft and a phenolic housing around the array of magnets. The shaft has an integral, polygonal center section providing mounting surfaces to which the magnets are attached. The magnets may be small, rare earth magnets attached to the polygonal center section with alternating magnetic poles facing outward (i.e., looking at each magnet face in turn as the shaft is rotated, the faces are arranged in a North-South-North fashion). While the illustrated embodiment shows eight magnets for an eight cylinder engine, for other applications, such as for engines with a fewer or greater number of cylinders, fewer or greater sides and corresponding magnets and stator windings can be utilized. The magnets are attached to the polygonal section of the shaft by a strong epoxy or other non-conductive adhesive material. The octagonal shape also provides a magnetic flux path that completes the magnetic circuit.

The epoxy material may not be sufficient to retain the magnets reliably at high shaft rotation speeds and high heat conditions. Therefore, the phenolic housing is attached to the shaft around the magnets. The phenolic housing may be filled with epoxy, filling all voids between the magnets. The epoxy and phenolic retainers effectively keep the magnets in place.

Certain prior magnetos use non-ferrous metal retainers, usually aluminum, which can be easily machined. While mechanically strong, these metallic retainers conduct electricity. Normal operation of these magnetos produces "eddy currents" in the magnets and their retaining devices. These eddy currents reduce the electrical efficiency of the generator and generate substantial heat, which further reduces efficiency and can damage the generator. The conductive retainers of the prior art can generate an enormous amount of excess heat due to the eddy currents, which can actually burn the generator windings.

By using phenolic retaining devices, the present invention produces relatively small eddy currents, thereby significantly reducing heat generation and increasing system efficiency. Since less heat is generated, the magnets do not reach or approach their critical or Curie temperature, which retains magnet power output (the Curie temperature is the temperature in which the atomic dipoles lose their alignment and thus their magnetic properties).

CONTROL BOX OPERATION

Normal system operation consists of "dwell" and "burn" periods. The system alternates between the two states, spending an approximately equal amount of time in each state. During dwell, no spark is delivered to any cylinder; during burn, spark energy is delivered to a given cylinder. The control box works in conjunction with the LED-based timing module in the generator to switch the system between dwell and burn.

IGNITION TRANSFORMER CONSTRUCTION AND OPERATION

The preferred ignition transformer used on the present invention shares several similarities with a normal automotive ignition coil. The magnetic core structure is a "full core," as contrasted to the more common "I core" used in conventional automotive coils. The primary and secondary windings are coaxial, with the secondary winding encircling the primary winding. As on a conventional coil, the two ends of the primary winding are connected to the (+) and (−) terminals of the transformer housing.

BRIEF DESCRIPTION OF THE DRAWINGS

The invention is described with reference to the following drawings in which like numerals refer to like elements and wherein.

DETAILED DESCRIPTION OF PREFERRED EMBODIMENTS

The present invention is a lightweight, high-power magneto assembly for use in the ignition systems of internal combustion engines. The magneto assemblies of this invention have particular application in internal combustion engines for automobiles and other land vehicles or boats. Due to the relatively high power output and low weight of the magneto assemblies of this invention, these magneto assemblies are particularly suited for drag racing. However, the magneto assemblies may be employed with any internal combustion engine.

Figure 1:
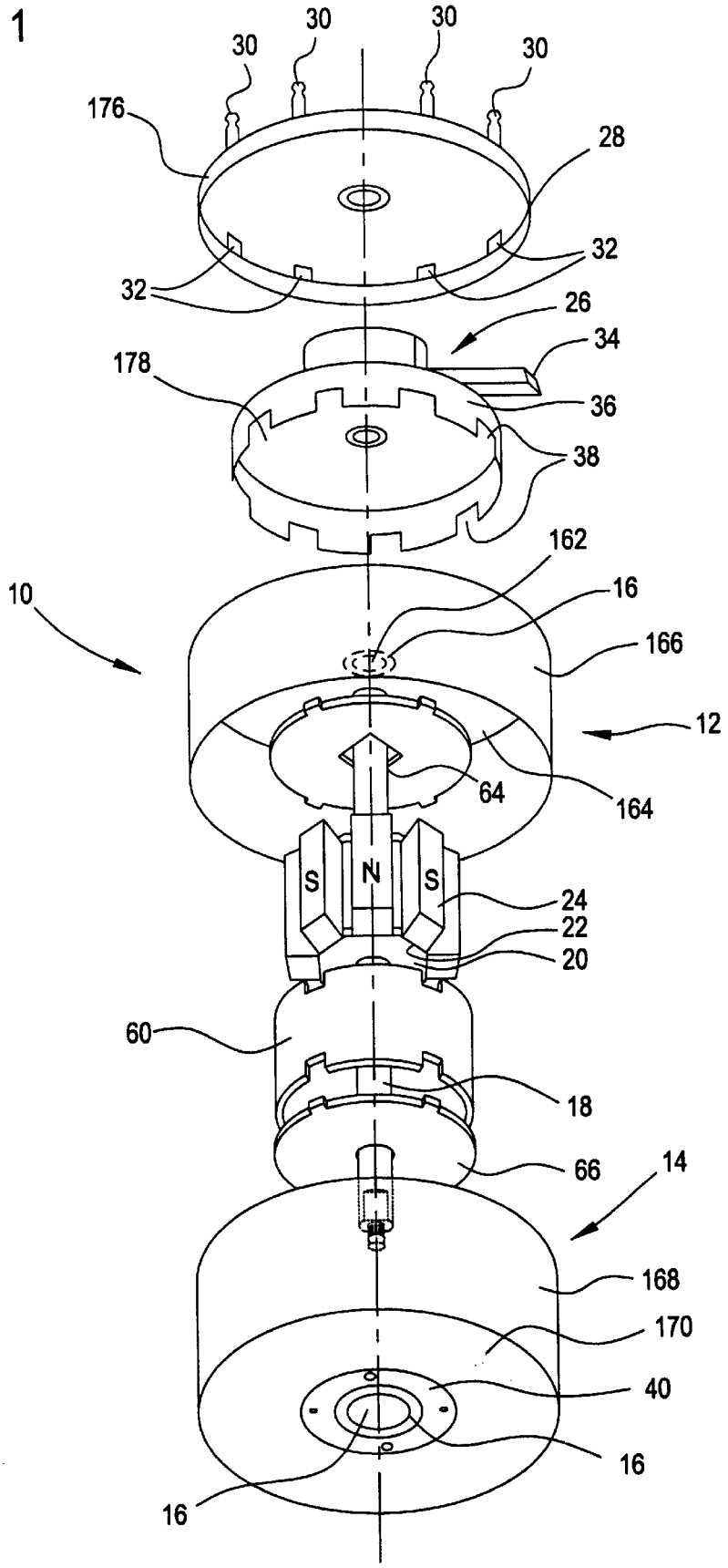
FIG. 1 is an exploded perspective view of a magneto assembly according to this invention and of a typical generator to which the magneto assembly is attached.

A preferred embodiment will be described with reference to the Figures. The overall magneto assembly consists of a generator unit (such as generator unit 10), a control box and an ignition transformer. Generator unit 10 preferably forms part of an engine distributor as shown in FIG. 1. Generator unit 10 includes upper housing assembly 12, lower housing assembly 14, poleshoe 160 and optical LED-based triggering module 52.

Upper housing assembly 12 includes cup member 166 and bearings 16. Cup member 166 includes end wall 164 which has aperture 162. Bearing 16 is fixedly received in aperture 162.

Figure 4:
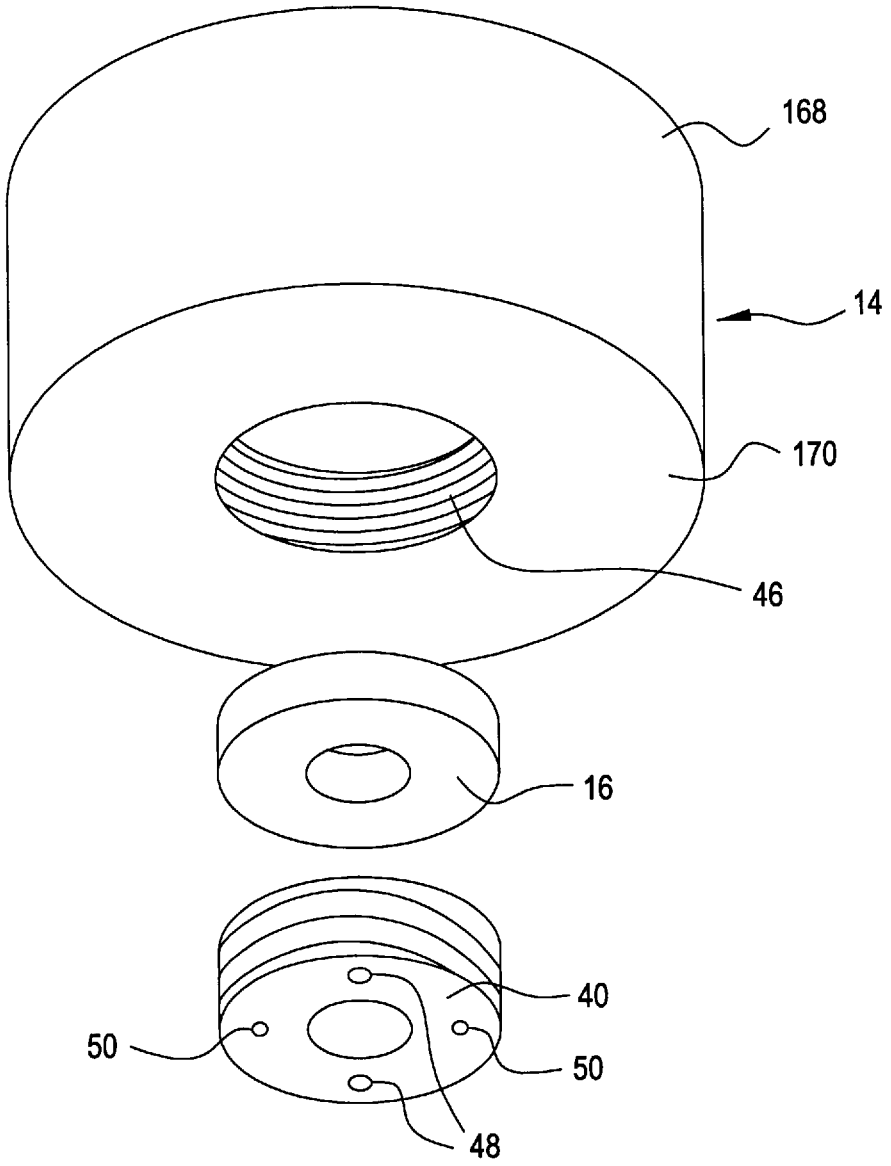
FIG. 4 is an exploded perspective view of the lower housing illustrated by FIG. 3.
Figure 5:
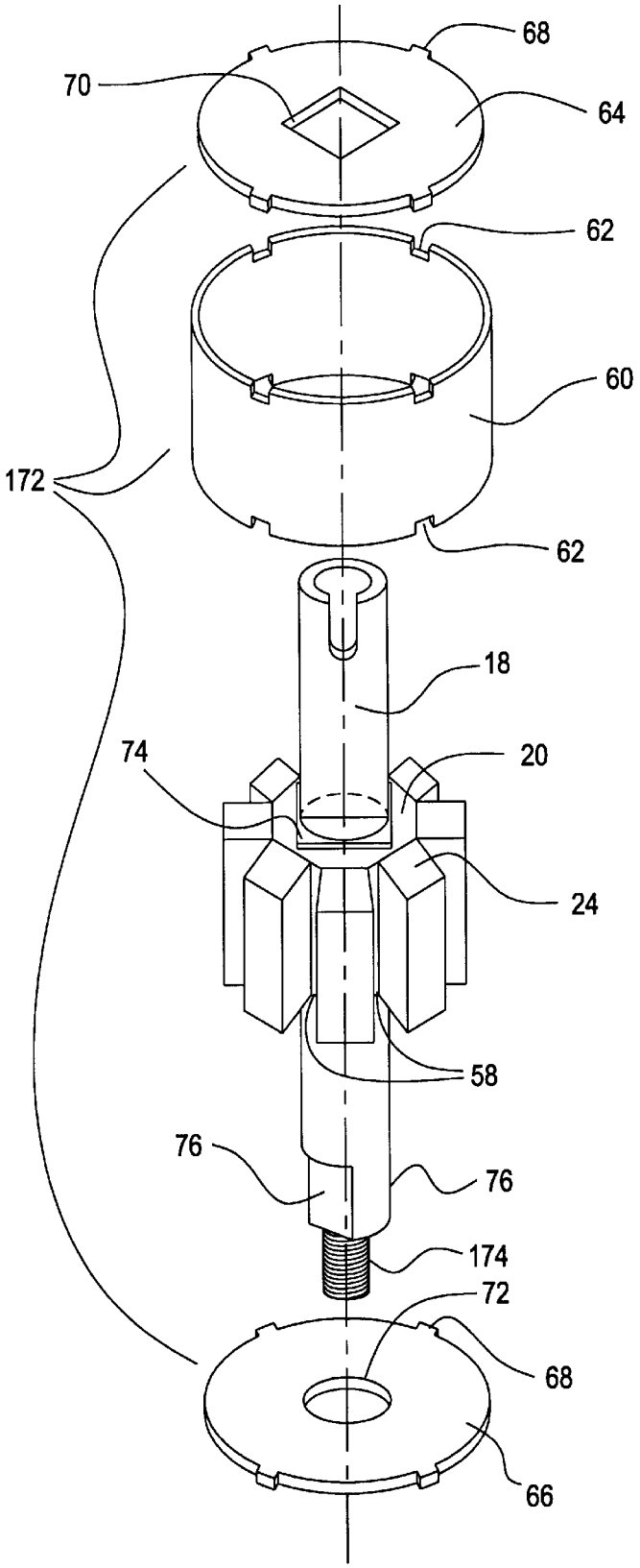
FIG. 5 is an exploded perspective view of the shaft and magnet poleshoe of the magneto assembly illustrated by FIG. 1.
Figure 6A:
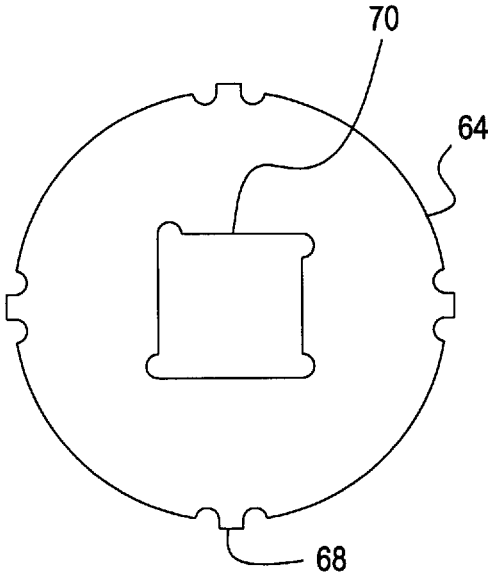
FIG. 6A is a top view of the top retaining device of the magneto assembly illustrated by FIGS. 1 and 5.
Figure 6B:
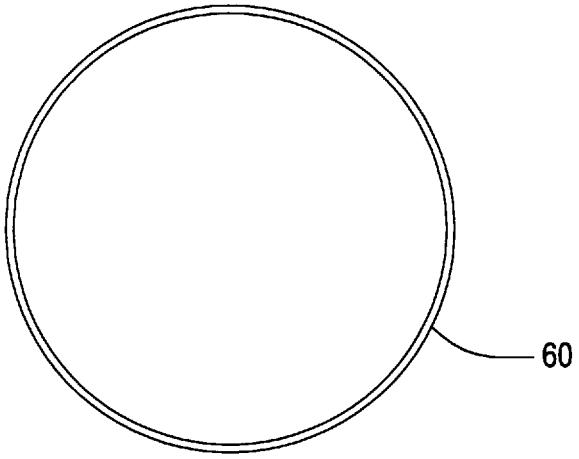
FIG. 6B is a top view of the middle retaining device of the magneto assembly illustrated by FIGS. 1 and 5.
Figure 6C:
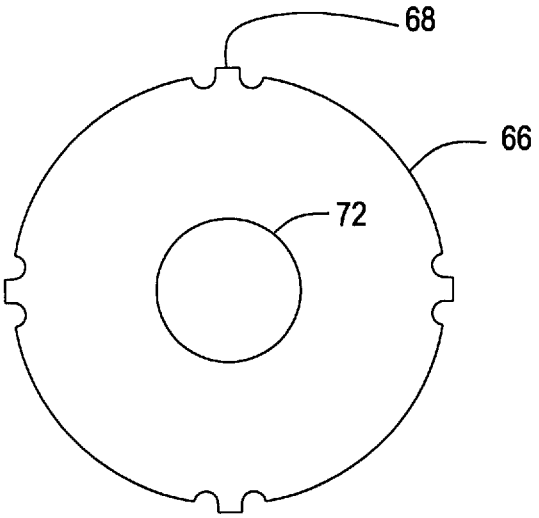
FIG. 6C is a top view of the bottom retaining device of the magneto assembly illustrated by FIGS. 1 and 5.

Lower housing assembly 14 includes cup member 168, bearing 16, bearing retainer 40 and eight stator windings 42. Cup member 168 includes end wall 170 which has threaded aperture 46 in end wall 170. As best illustrated in FIG. 4, retainer 40 threads into threaded aperture 46 in lower housing 14. Lower shaft bearing 16, which is preferably a rolling element bearing, is placed in aperture 46, on top of retainer 40. Retainer 40 allows minor adjustments in the axial orientation of shaft 18 of poleshoe 160 (described below), such that a selectable freeplay can be placed on shaft 18 or a selectable preload can be placed on bearings 16. This adjustment is achieved by rotating retainer 40 with respect to the threads of aperture 46, thus incrementally adjusting the axial position of bearing 16 relative to end wall 170. Once threaded into a desired position, set screws or other fixing means 48 can be provided to lock retainer 40 in place. Additionally, holes or other removal means 50 such as slots, keys or the like can be provided to allow removal of retainer 40 with an appropriate tool. Thus, when assembled properly, bearing retainer 40 not only provides the appropriate orientation of poleshoe 160, but also provides the proper preload on the rolling element bearings 16.

Figure 3:
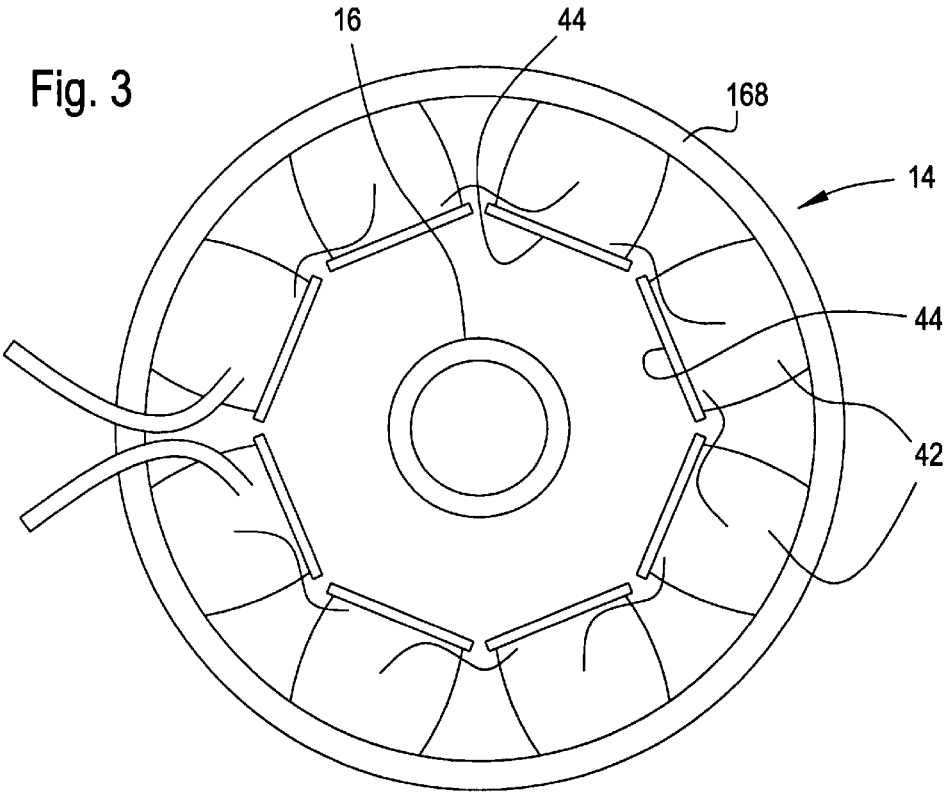
FIG. 3 is a top view of the lower housing of the magneto assembly illustrated by FIGS. 1 and 2.

As best shown in FIG. 3, lower housing 14 includes eight stator windings 42 spaced and fixedly mounted around the inner periphery of cup member 168. Stator windings 42 include interior conducting elements 44. When poleshoe 160 is installed, a predetermined radial gap exists between elements 44 of stator windings 42 and the magnets 24 of poleshoe 160 (described below). Due to the configuration of the present invention, this gap can be increased and may be larger than 1 mm, preferably in the range of 1–2 mm.

Cup members 166 and 168 are preferably formed of machined aluminum and are oriented with the open ends of the "cups" facing each other. Cup members 166 and 168 are of a relative size such that cup member 166 fits within cup member 168, although this relationship can obviously be reversed and achieve the same effect.

Poleshoe 160 includes generator shaft 18, magnets 24, and phenolic housing 172. Shaft 18 is preferably made from steel and is provided with octagon section 20 defining exterior magnet surfaces 22, square boss 74, double flat section 76, and threaded end 174. Conventional magneto assemblies employ a woodruff key to connect the shaft of the poleshoe to a drive assembly. However, as to the magneto assemblies of this invention, the torque required to rotate the magneto assemblies is much greater than conventional magneto assemblies. This requires a different drive arrangement due to the fact that the torque capacity of a woodruff key may be exceeded by the magneto assemblies of this invention. Accordingly, a "double flat" 76 connection is used. Double flat connection 76 transmits torque directly to the shaft without any intermediate parts like woodruff keys and allows the magneto to rotate at high speed without shaft failures. For lower power transmitting requirements, such as for use on standard engines or mild racing engines, a single flat 76 may be sufficient.

Magnets 24 are attached to octagon section 20 of shaft 18 by a strong epoxy 58 or other non-conductive adhesive material. The octagonal shape provides a magnetic flux path that completes the magnetic circuit.

The epoxy material 58 may not be sufficient to retain magnets 24 reliably at high shaft rotation speeds and high heat conditions. Under these conditions, the centrifugal force on the rotating magnets 24 may cause them to separate from shaft 18, if not properly restrained by additional restraining means.

Therefore, in the present invention, phenolic housing 172 is provided. Phenolic housing 172 includes ring 60 and interlocking top and bottom endcaps 64 and 66. Phenolic housing 172 encompasses magnets 24. Preferably, ring 60 has a height that is substantially equal to the axial length of magnets 24 and an inner diameter that is substantially the same as the outer diameter of the radial magnet array. Ring 60 has a thickness of about 1 mm. Ring 60 is provided with slots 62 around the periphery of both ends. Interlocking top and bottom endcaps 64, 66 include projections 68 that mate with slots 62 of ring 60. Top endcap 64 is provided with a non-circular aperture 70, preferably square, while bottom endcap 66 is provided with a circular aperture 72. Non-circular aperture 70 mates with corresponding boss 74 on shaft 18 to prevent rotation of endcap 64, and thus phenolic housing 172, relative to shaft 18. Circular aperture 72 is received over shaft 18 and allows for rotation of bottom retaining endcap 66 prior to mating of endcap 66 to ring 60 and top endcap 64.

Phenolic housing 172 may be assembled as follows: Top endcap 64 is placed on and mated with boss 74 of shaft 18. Then, ring 60 is placed around magnets 24 and corresponding slots 62 are mated with projections 68 of top endcap 64. Now, both ring 60 and top endcap 64 are prevented from rotation relative to the shaft 18. Bottom endcap 66 is then placed over the shaft and rotated until projections 68 are placed in mating engagement with corresponding slots 62, thus retaining the entire retaining housing 172 from rotational movement relative to shaft 18.

While four slots 62 are shown, it will be apparent that more or less could be used depending on the application, materials used and other considerations. Moreover, the specific shape and/or size of the slots and corresponding projections could be modified or even reversed (i.e., ring 60 could be provided with longitudinally extending projections rather than slots or could include both slits and projections in an alternating fashion). Further, while a square boss 74 is preferred, other suitable non-circular shapes capable of locking the cap in place to prevent rotation may be employed.

Preferably, the entire phenolic housing 172 is further filled with epoxy, filling all voids between the magnets. The epoxy and phenolic housing 172 very effectively keep the magnets in place, even during very high rotational speeds.

Poleshoe 160 produces relatively small eddy currents compared to prior magneto systems, thereby significantly reducing heat generation and increasing system efficiency. Since less heat is generated, the magnets do not approach their critical or Curie temperature, thus retaining their magnet power output (the Curie temperature is the temperature in which the atomic dipoles lose their alignment and thus their magnetic properties).

Because of the greatly increased efficiency of the shaft assembly of this invention, due to decreased eddy currents, the clearances between poleshoe 160 and stator windings 42 can be significantly increased from prior magneto assemblies without loss of efficiency. This allows the magneto assemblies of this invention to be built with greater clearances, 1–2 mm, which vastly simplifies manufacture and assembly.

Further, due to the fact that poleshoe 160 is much smaller and lighter than the poleshoes of prior magnetos, housing assemblies 12 and 14 are correspondingly smaller and lighter as well. Upper and lower housing assemblies 12, 14, when assembled, "sandwich" the series wound stator windings 42 between them, thus maintaining the necessary spacing between windings 42 and poleshoe 160. Due to manufacturing tolerances on all of the manufactured parts and the thickness of stator windings 42, which are made of laminations, considerable dimensional differences can occur between housing assemblies 12, 14 and poleshoe 160. To compensate for the manufacturing tolerances, adjustable bearing retainer 40 can be adjusted and affixed to end wall 170 of cup member 168, to provide the necessary longitudinal spacing between housing assemblies 12, 14 and poleshoe 160, as discussed above.

Figure 2:
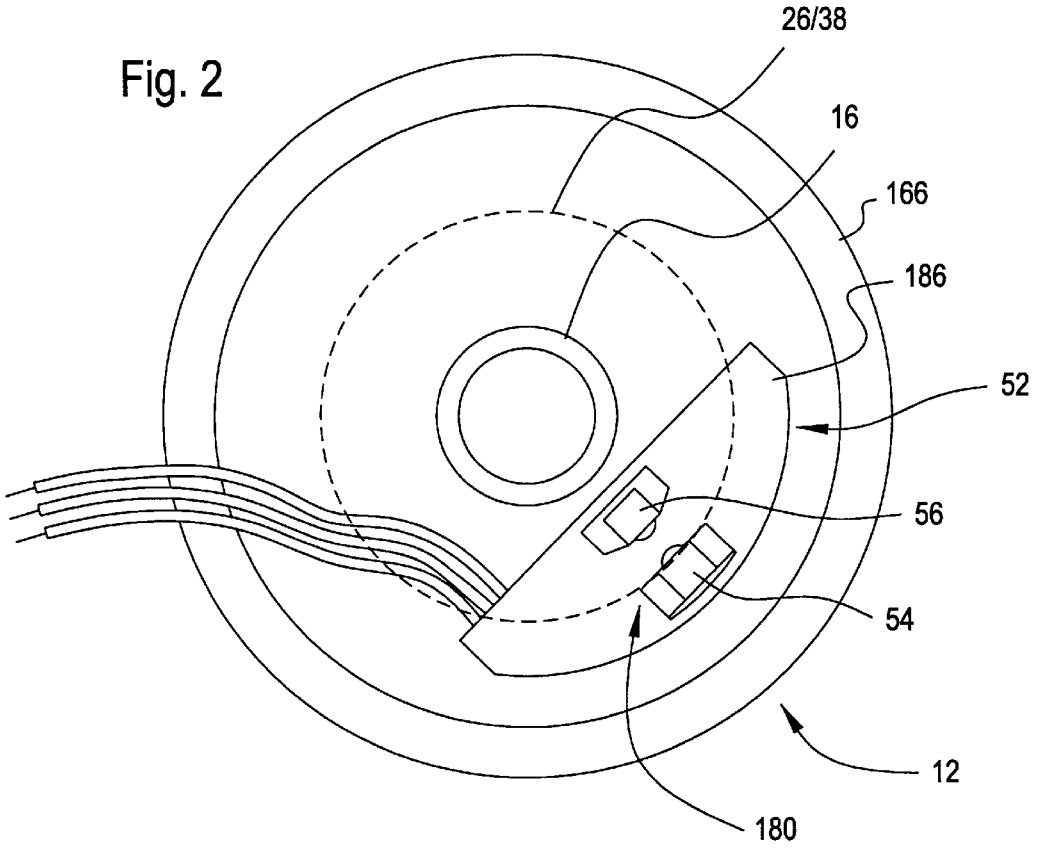
FIG. 2 is a top view of the magneto assembly and generator illustrated by FIG. 1.

Optical LED-based triggering module 52 includes plate 186, LED's 54 and 56 and power transistor 180. Plate 186 is removably attached to upper housing 12. LED's 54 and 56 are attached to the top of plate 186 as shown in FIG. 2.

As illustrated in the Figures, generator unit 10 is designed to be employed with a distributor, typically comprised of a distributor rotor, such as distributor rotor 26, and a distributor cap, such as distributor cap 28.

Distributor rotor 26 is fixedly attached to shaft 18. Distributor cap 28 is mounted above rotor 26, but is not attached to rotor 26. Distributor cap 28 remains stationary when shaft 18 rotates.

Cap 28 includes plate member 176 and eight equally-spaced brass members 30 for receiving spark plug wires. Each brass member 30 has a lower extremity 32 which passes through plate member 176 and electrically contacts rotor element 34 of rotor 26 during rotation of rotor 26 (described below).

Rotor 26 includes plate member 178, rotor element 34, and downwardly projecting cylindrical portion (shutter wheel) 36 having eight equally spaced openings or slots 38, one for each cylinder of the engine.

As best illustrated in FIG. 2, the slots 38 in rotor 26 pass between LEDs 54, 56 and are used as timing signals for the ignition system, the operation of which will be described below.

Poleshoe 160 is driven at one-half the speed of the engine crankshaft, through conventional and unillustrated drive structure, and timed with respect to stator windings 42 so that the electrical current from stator windings 42 reaches maximum amplitude just before a given spark is to occur. This alternating electrical current is rectified to direct current by a control box and shunted to chassis ground until it is time for a spark. As rotor 26 is fixedly attached to shaft 18, it rotates therewith relative to fixed distributor cap 28 and fixed LED-based optical module 52.

As rotor 26 rotates, rotor element 34 comes in the close vicinity of each brass member 30 and transfers current (spark) from the magneto assembly to individual spark plugs attached to each brass member through a spark plug wire (not shown). LED-based timing module 52 in the generator unit signals that it is time for a spark when the LED's 54, 56 detect a transition between two operational states. This is achieved, for example, by shutter wheel 36 detecting either an open state, in which LED's 54, 56 have one of slots 38 interposed between the LED's (no blockage), or a closed state, in which LED's 54, 56 have a portion of shutter wheel 36 between slots 38 interposed between LED's 54, 56 (blockage).

When module 52 signals that it is time for a spark, the control box becomes an open circuit to the electrical current. The current is no longer rectified nor shunted to chassis ground. The magnetic field that had been formed in stator windings 42 by electrical current then collapses, inducing a large pulse of electrical current to the control box and an ignition transformer. Since the control box is open circuited, the pulse is forced to flow through a transformer primary winding. The transformer "steps up" the voltage according to its turns ratio, providing a high voltage pulse through the magneto assembly to distributor rotor 26 and to one spark plug connected to distributor cap through brass member 30.

Figure 9:
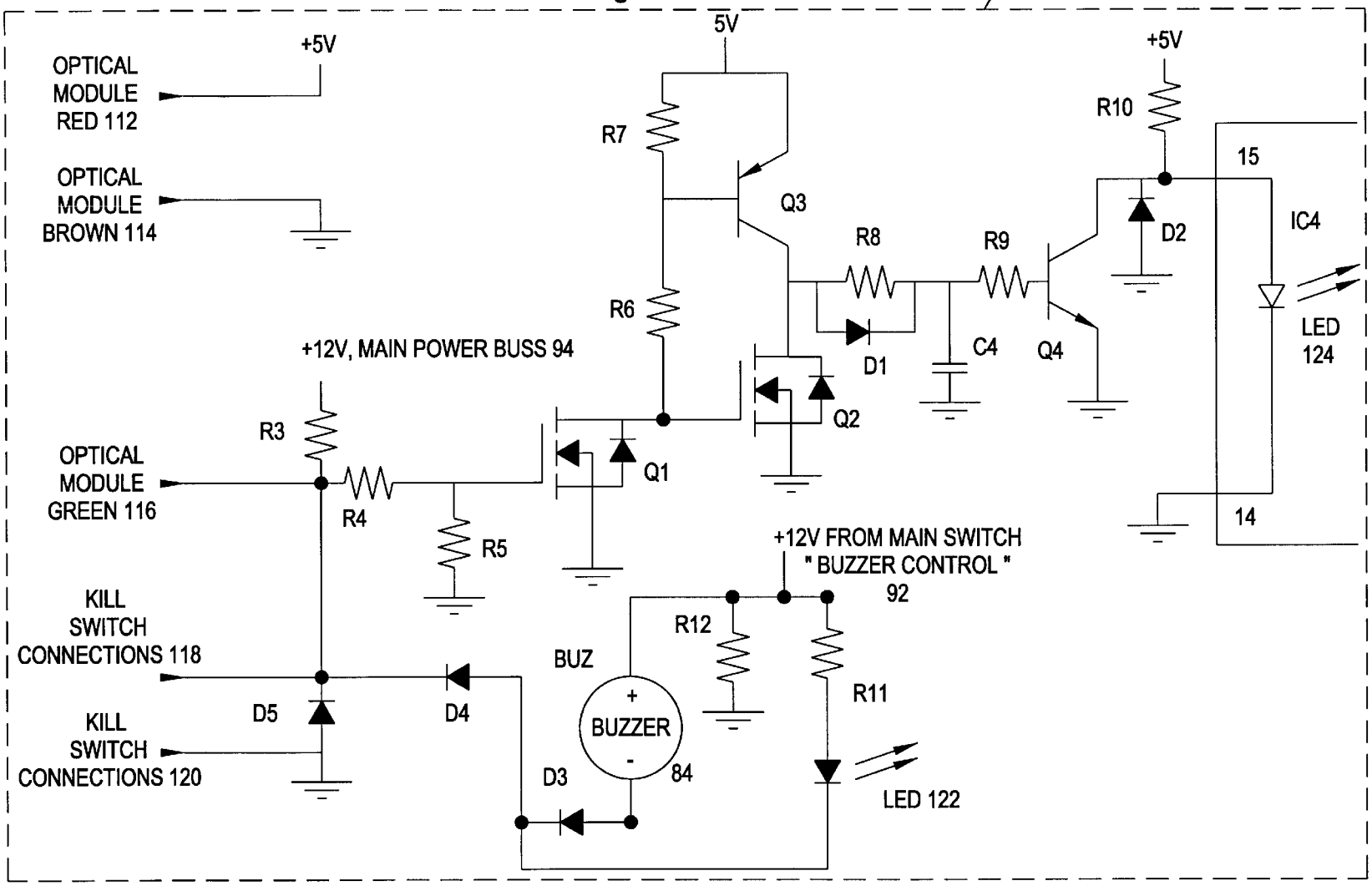
FIG. 9 is a schematic of an input circuit of the control box according to the invention.
Figure 10:
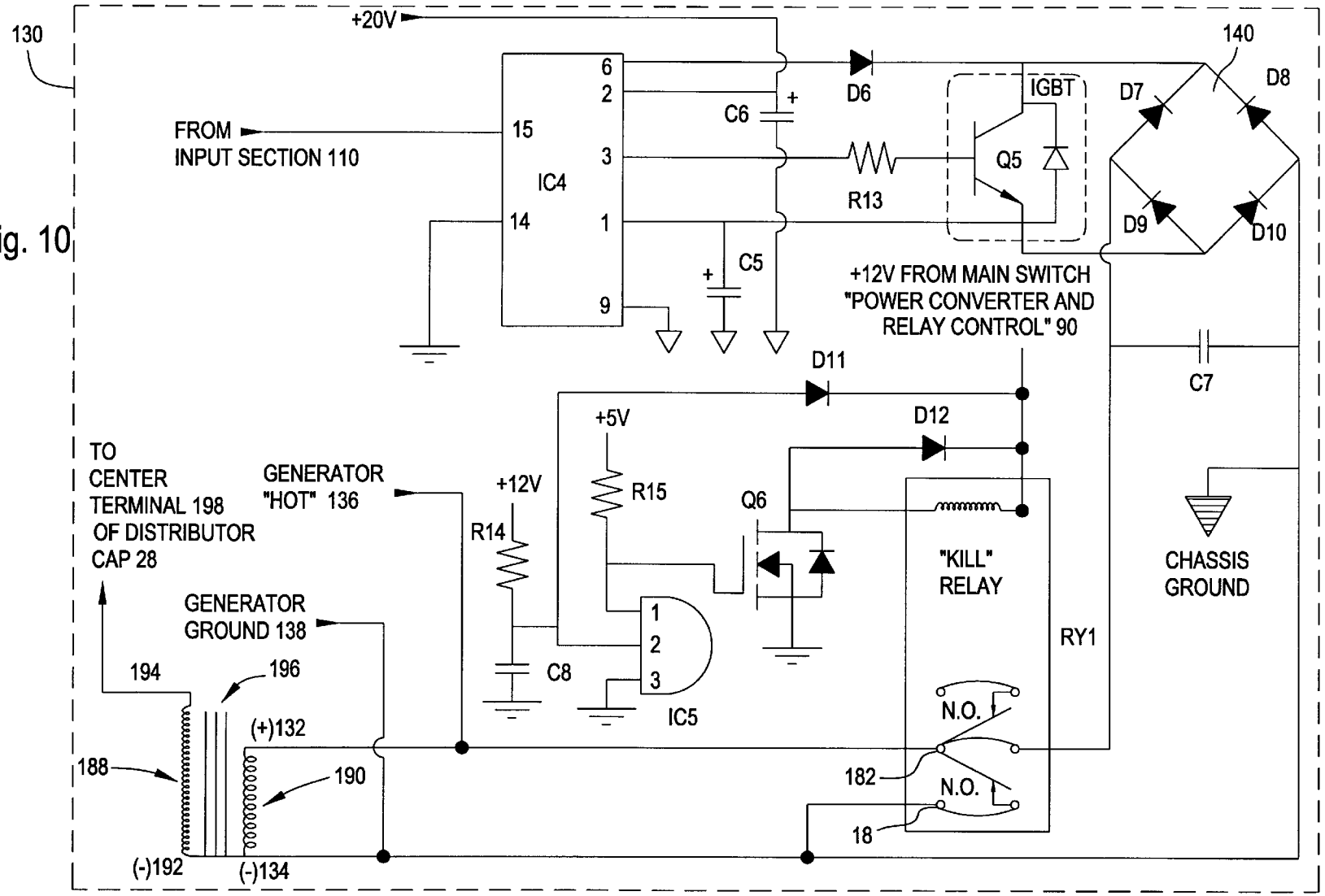
FIG. 10 is a schematic of a coil control circuit of the control box according to the invention.
Figure 11:
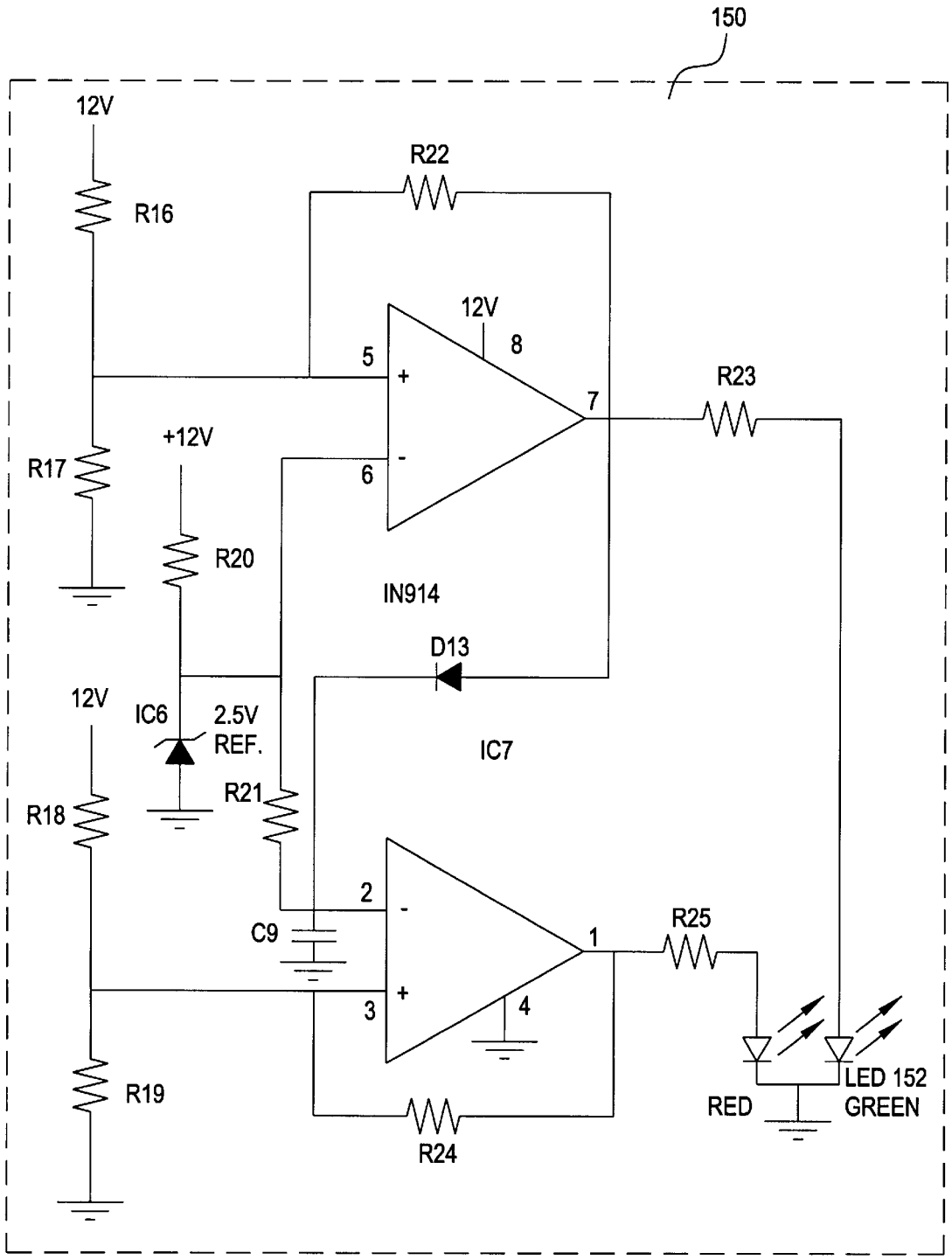
FIG. 11 is a schematic of a battery monitor circuit of the control box according to the invention.

The circuitry of the control box is illustrated in FIGS. 7–11. The control box includes five circuits: the main switch circuit 80 (FIG. 7); the power supply circuit 100 (FIG. 8); the input circuit 110 (FIG. 9); the coil control circuit 130 (FIG. 10); and the battery monitor circuit 150 (FIG. 11). The magneto assembly of this invention has two operating states: "dwell" and "burn" states. The assembly alternates between the two states, spending an approximately equal amount of time in each state. During the dwell state, no spark is delivered to any cylinder. During the burn state, spark energy is delivered to a given cylinder. The control box works in conjunction with LED-based timing module 52 in generator unit 10 to switch the system between dwell and burn states.

Figure 7:
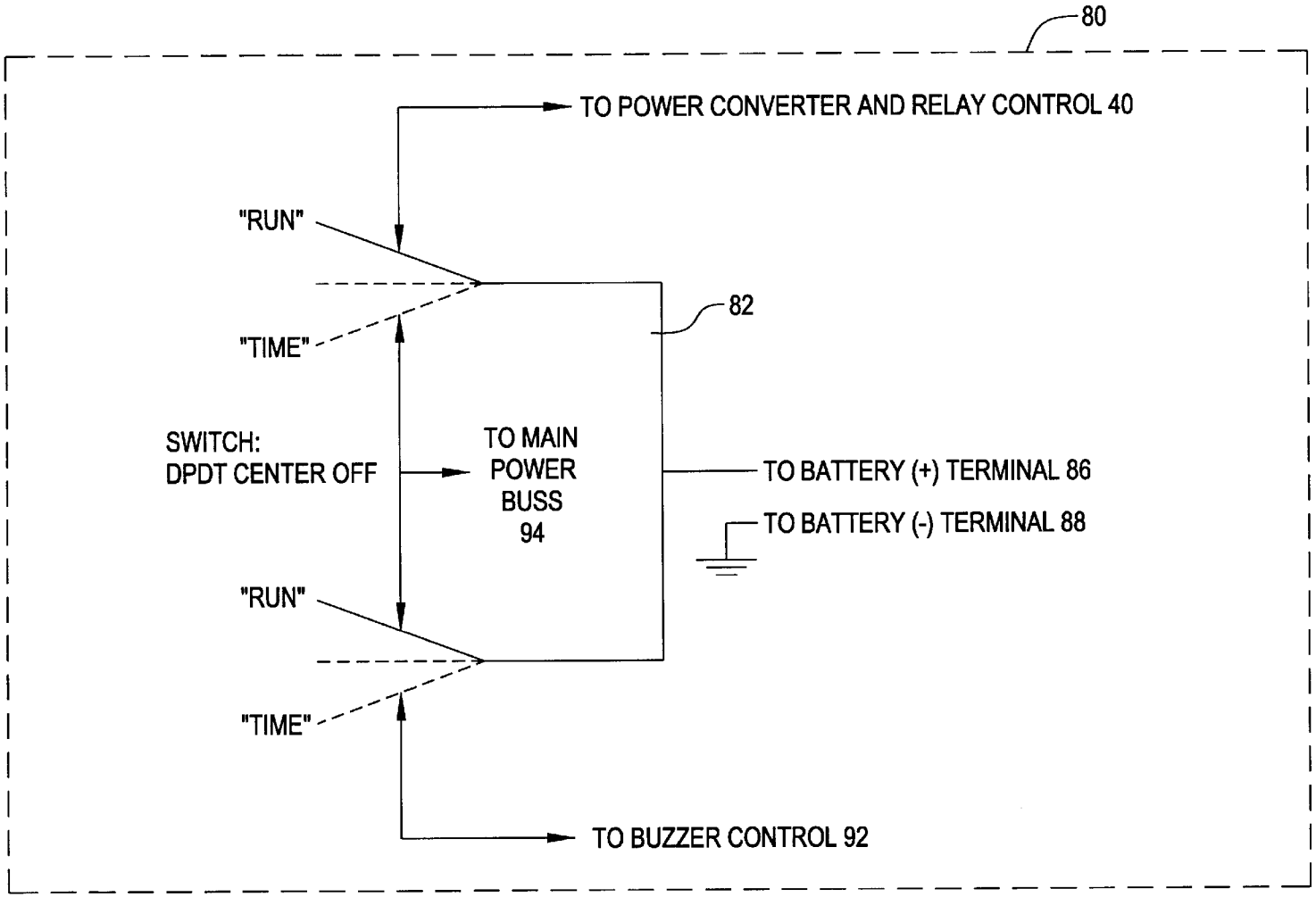
FIG. 7 is a schematic of the main switch of the control box according to the invention.

With reference to FIG. 7, main switch circuit 80 includes switch 82 connected to buzzer control line 92, power converter and relay control line 90, main power buss 94, and battery terminals 86 and 88. Main switch 82 is preferably a double-pole, double-throw, center-off switch. In the "Off" position, all power is disconnected from the circuitry of the control box. The other two switch positions are "Time" and "Run." In the "Time" position, the ignition transformer primary is short-circuited so that no spark can be generated by the system. Static timing buzzer 84, also mounted on the front panel, is activated when main switch 82 is in the time position. Buzzer 84 emits a loud audio tone when optical module 52 in the generator is in the dwell state, and ceases the emission as soon as shaft 18 turns far enough to attain the burn state. Buzzer 84 is employed to time the engine ignition statically.

Specifically, generator unit 10 is adjusted radially (rotated clockwise or counter clockwise) until, as the engine crankshaft is rotated by hand in the normal direction of rotation, the tone from buzzer 84 stops just as the desired ignition timing point is reached.

Power for the control box is provided by a rechargeable, sealed lead-acid battery having (+) terminal 86 and (−) terminal 88. Fully charged, the battery can provide 4 hours of continuous "Run" operation or 20 hours of continuous "Time" operation. Power from the battery is routed to circuits 80, 100, 110, 130 and 150 via main switch 82. There are three 12V lines from main switch 82, labeled as follows: 1) power converter and relay control line 90 (powered only when the main switch is set to "Run"); 2) buzzer control line 92 (powered only when the main switch 82 is set to "Time"); and 3) main power buss 94 (powered when the main switch 82 is set to either "Run" or "Time").

Figure 8:
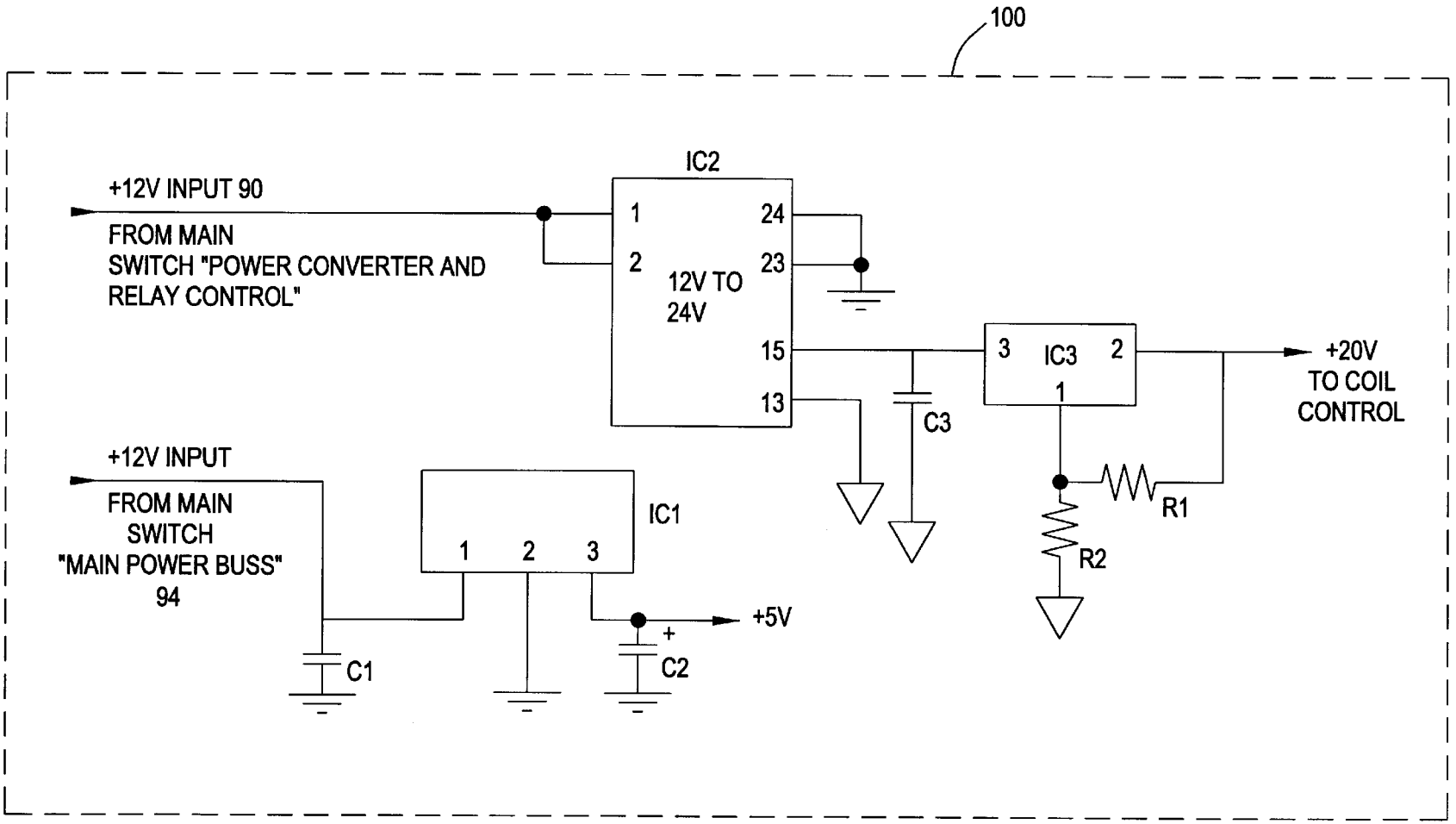
FIG. 8 is a schematic of a power supply circuit of the control box according to the invention.

With reference to FIG. 8, power supply circuit 100 includes a 5 volt regulator IC1, DC/DC converter IC2, adjustable voltage regulator IC3, and capacitors C1–C3. Regulator IC1 is powered from the main power buss 94 and regulates the incoming 12V down to 5V. Capacitors C1 and C2 provide noise filtering of incoming and outgoing power, respectively. DC/DC converter IC2 is powered by power converter and relay control line 90 and converts the incoming +12V to +24V, referenced to a "floating ground." Converter IC2 provides +24V to adjustable voltage regulator IC3, whose output voltage is set to +20V+/−1V by R1 and R2, C3 filters noise from the incoming power from IC2.

There are three distinct, isolated, grounds in this system: 1) battery ground, connected to the (−) terminal 86 of the battery, schematic reference ⏚; 2) chassis ground, connected to the car chassis and engine block (not shown), schematic reference ⏚; and 3) floating ground, schematic reference ⏚.

With reference to FIG. 9, input circuit 110 includes IGBT driver chip IC4, buzzer 84, diodes D1–D5, resistors R3–R12, transistors Q1–Q4, LEDs 122 and 124, optical module wires 112, 114, and 116, capacitor C4, and kill switch connections 118, 120. The entire input circuit is referenced (connected) to battery ground.

LED-based trigger module 52 is basically an infrared-controlled power transistor (designated as power transistor 180 in FIG. 2). Module 52 includes wire 112 connected to a +5V supply, wire 114 connected to battery ground, and wire 116 connected to input circuit 110 and described in detail later. Shutter wheel 36 interrupts an infrared light beam when the system is in the dwell state. When the light beam is interrupted, power transistor 180 is turned "on," effectively short circuiting the optical module wire 116 and wire 114 together. As shaft 18 turns, openings or slots 38 in the shutter wheel 36 permit the beam to pass between LEDs 54 and 56, which turns the power transistor "off," disconnecting wire 116 from battery ground and switching the system to the "burn" state. There are the same number of openings/slots 38 in the shutter wheel 36 as cylinders in the engine. In the Figures, shutter wheel 36 has eight slots 38. Based on positions of main switch 82 and shutter wheel 36, there are four operating conditions of the input circuit: "Run" dwell, "run" burn; "time" dwell and "time" burn. Each of these four conditions will now be separately described.

1) "Run" dwell: This condition occurs when the power transistor 180 in module 52 is "on," such that wire 116 is "pulled down" (voltage decreased) to the saturation voltage of the optical module power transistor, typically 1.0–1.5V. The +12V line 92 to buzzer 84, resistor R11, and resistor R12 is not energized, so diode D4 stops any interaction between buzzer 84 and the remainder of the circuit. Resistors R4 and R5 further divide the saturation voltage from wire 116 so the voltage at the gate of transistor Q1 (a P-channel MOSFET with a minimum gate turn-on voltage of 0.8V) is reduced to +0.5V or less. Therefore, transistor Q1 is "Off." Transistor Q2 is also a P-channel MOSFET; with transistor Q1 off, resistors R6 and R7 pull the gate of transistor Q2 to +5V turning it "on." Since there is no current flow through resistors R6 and R7, transistor Q3, a PNP Bipolar Transistor, is "off." Being a MOSFET, the on-resistance of transistor Q2 is about 8 ohms between its drain and source. This low on-resistance means the voltage at the base of transistor Q4, an NPN BJT, is virtually zero. Therefore, transistor Q4 is "off." There is an internal LED 124 connected between pins 15 and 14 of IC4 that provides optical coupling to the rest of the circuitry in IC4. With transistor Q4 "off," current from the +5V line flows through LED 124, turning it "on." Resistor R10 limits this current to a safe level for LED 124.

2) "Run" burn: This condition occurs when power transistor 180 in module 52 is "off," such that wire 116 is "pulled up" (voltage increased) by resistor R3, which is connected to +12V by the main power buss 94. Resistors R3, R4, and R5 divide this voltage down to +3.5V at the gate of transistor Q1, turning it "on." This, in turn, reduces the voltage at the gate of transistor Q2 to virtually zero, turning it "off," while simultaneously turning transistor Q3 "on." Therefore, current flows from the +5V line, quickly charging capacitor C4 via diode D1 to approximately +4.3V. This, in turn, applies sufficient current to the base of transistor Q4 via R9 to turn it "on." With Q4 "on," the voltage at pin 15 of IC4 is reduced to approximately +0.3V, turning the internal LED 124 "off," which in turn signals the internal circuitry of IC4 to begin the spark. The spark itself, and the current in the high tension spark plug leads, generates sufficient EMI to briefly turn power transistor 180 in the generator optical module 52 back "on," i.e., it briefly and erroneously signals transistor Q1 that dwell is beginning. Resistor R8, diode D1, and capacitor C4 form a filter network to prevent this "false trigger" from reaching transistor Q4. This false trigger briefly turns transistor Q2 "on" and transistor Q3 "off." Resistor R8 controls the discharge rate of capacitor C4, so the voltage on capacitor C4 does not drop low enough to turn transistor Q4 "off" before the false trigger ends. Therefore, the spark-induced false trigger does not cause a malfunction.

3) "Time" dwell: This condition results when the circuitry is in the position described in "run" dwell condition (1) and buzzer 84, resistor R11, and resistor R12 are connected to +12V. During dwell, transistor 180 is "on," so the optical module wire 116 is "pulled down" to approximately +1.0–1.5V. Therefore, diodes D3, D4, and LED 122 are forward biased, and the buzzer 84 emits a tone. Resistor R11 limits the current through LED 122. Resistor R12, diode D3, diode D4, and diode D5 are all provided to prevent EMI from interacting with the buzzer 84, LED 122, and the kill switch wiring connections 118, 120 to cause false trigger problems in the "Run" mode.

4) "Time" burn: This condition occurs when the circuitry is in the same position as "run" burn, except optical module 52 transistor 180 is "Off," so the optical module wire 116 is "pulled up" toward +12V by resistor R3. Therefore, there is no current flow through the buzzer 84 or LED 122, so no audio tone is emitted, and LED 122 does not light up.

Kill switch operation can also occur in any of the operating conditions to stop the engine from running. In the "Run" condition, the optical module wire 116 is connected to battery ground, forcing the rest of the input circuit 110 to the "dwell" condition regardless of the signal from the optical module 52. Similarly, in the "Time" condition, the buzzer 84 and LED 122 operate continuously, regardless of the optical module signal.

The coil control circuit 130 (FIG. 10) includes a "Kill Relay" section and a "Coil Switching" section. These sections are individually discussed below.

1) Kill Relay section: the Kill Relay section includes kill relay RY1, voltage sensor IC5, resistors R14 and R15, diodes D11 and D12, capacitor C8, and transistor Q6. Power converter and relay control line 90 supplies +12V to the Kill relay section from main switch 82. Line 90 is only active when main switch 82 is in the "Run" position. In the "Off" and "Time" positions, there is no power available for relay coil 132, 134, so normally closed relay contacts 182, 184 short circuit wires 136, 138 from generator unit 10 and the ignition transformer. This prevents any spark from being generated.

When main switch 82 is set to "Run," +12V is applied to one (+) terminal 132 of the relay coil and to resistor R14. Resistor R14 and capacitor C8 form a resistor-capacitor delay circuit along with comparator circuit IC5. Voltage sensor IC5 has an open collector output connected to pin 1 and a sensing input connected to pin 2. When the voltage on pin 2 is below 4.6V, pin 1 is essentially connected to battery ground. This keeps transistor Q6, a P-channel MOSFET, turned "off," so no current flows through the relay coil. About 0.5 seconds after the main switch 82 is set to "Run," the voltage on capacitor C8 rises past +4.6V, causing pin 1 of voltage sensor IC5 to disconnect from battery ground. Resistor R15 then "pulls up" the gate of transistor Q6 to +5V, turning it "on." This connects relay terminal 132 to battery ground, activating the relay coil 132, 134, which in turn disconnects generator and ignition trans-former wires 136 and 138 from each other, allowing normal ignition operation. This 0.5 second delay allows the control electronics to power up to steady state before exposing them to generator power. This is done because the engine crankshaft is typically spun at about 300 RPM to build oil pressure and ingest fuel into the cylinders before the main switch 82 is set to "Run" to start the engine.

2) Coil switching section: The coil switching section includes IGBT drive chip IC4, capacitors C5–C7, resistor R13, transistor Q5 and diode bridge 140 (diodes D7–D10). The basic premise of the coil switching section is to short circuit the wires 136, 138 from generator unit 10 and the ignition transformer during "dwell," then remove the short circuit during "burn." These two conditions are discussed below:

Dwell: During dwell, the input circuit 110, as detailed in the paragraphs above, supplies current to the built-in LED 124 that is connected between pins 15 and 14 of IC4. When LED 124 is "on," it activates switching circuitry in the chip that is referenced to the "floating ground." As referenced to floating ground, pin 2 of IC4 is supplied +20V from the regulator described in the power supply section above. During dwell, pin 3 of IC4 is also at +20V, and pin 1 of IC4 is at approximately +5V. This causes the base of transistor Q5, an Insulated Gate Bipolar Transistor (IGBT), to be forward biased, so it turns "on," effectively shorting the collector of transistor Q5 to its emitter. Diodes D7, D8, D9, and D10 form diode bridge 140 that rectifies the incoming current from the generator to direct current. When transistor Q5 is "on," the DC side of diode bridge 140 is "shorted out." Since one generator lead 138 is always tied to chassis ground, the effect of shorting the diode bridge 140 is to shunt the current from the "hot" lead 136 of the generator to chassis ground.

Burn: During burn, the input circuit 110 stops supplying current to the built-in LED 124 connected between pins 15 and 14 of IC4. Therefore LED 124 is "off," so the switching circuitry in IC4 that is referenced to floating ground supplies approximately +0.08V to pin 3 of IC4, and approximately +5V to pin 1 of IC4. This reverse biases the base of transistor Q5, so it turns "off," effectively disconnecting the collector of transistor Q5 from its emitter. Therefore, the DC side of the diode bridge formed by diodes D7, D8, D9, and D10 is open circuited. This means the current supplied by generator 10 is no longer shunted to chassis ground as it was during dwell, so it is forced to go through the ignition transformer primary winding 190. The collapsing magnetic field in the generator windings 42 supplies an inductive "kick" of current to the transformer primary winding 190, causing the voltage across the primary winding 190 to rise sharply to several hundred volts. Capacitor C7 controls the rise time of this voltage, and also forms a "tank circuit" with the transformer primary winding 190. This increases the efficiency of energy transfer from the primary winding 190 to the secondary winding 188. Resistor R13 in the base lead of transistor Q5 slows the switching response of transistor 5 to prevent false switching due to EMI when the spark occurs.

Capacitors C5 and C6 help filter any electrical "noise" that may impinge on pins 1 or 2 of IC4. Diode D6, connected between pin 6 of IC4 and the collector of transistor Q5, supplies a small amount of current from pin 6 to the collector of transistor Q5 during dwell as part of an overcurrent monitoring function built into IC4. This function is not used in this application, but diode D6 must be installed for IC4 to operate properly.

Battery monitor circuit 150 monitors the terminal voltage of the system's +12V sealed lead-acid battery. Battery monitor circuit 150 includes resistors R16–R25, voltage reference IC6, dual operational amp IC7, diode D13 and bicolor LED 152 (see FIG. 11). When main switch 82 is set to either "Run" or "Time," bicolor LED 152 provides a visual indication of the battery state. If the battery terminal voltage is above approximately +11.9V, LED 152 emits green light, indicating a "good" state of charge of the battery. If the battery terminal voltage is between +11.6V and +11.9V, LED 152 emits red light, indicating the battery is "low," but still has sufficient charge to statically time or run the car at least once. If the battery terminal voltage is below +11.5V, LED 152 does not emit any light, indicating that the battery must be recharged before the car can be statically timed or run.

The details of the circuit operation in each of the three states is as follows:

Battery terminal voltage above +11.9V: The circuit is based around a dual op-amp being utilized as a dual comparator. The (−) terminal of both op amps of IC7 is connected to a precision +2.5V reference IC6. Voltage reference IC6 can basically be thought of as a very accurate +2.5V zener diode, with resistor R20 providing the current limiting for voltage reference IC6. Resistor pairs R16 and R17, and R18 and R19, are comprised of precision, 1% tolerance metal film resistors that provide voltage-divided readings of the battery terminal voltage to the (+) inputs of the op-amps. Above +11.9V, both (+) inputs are above the +2.5V reference. This would cause the output of both op-amps to be "high," except the output of the "green light" op-amp is fed back to the (−) input of the "red light" op-amp via diode D13. This forces the (−) input to over +11V, which in turn causes the output of the "red" op amp to go "low." Therefore, LED 152 emits green light. Resistor R21 prevents the fed back current from disturbing the +2.5V output from voltage reference IC6.

Battery terminal voltage between +11.6V and +11.9V: At this voltage, the (+) input of the "green" op amp is below +2.5V, so the "green" op amp output goes "low," and D13 is back biased. The (−) input of the "red" op amp reverts to +2.5V; the (+) input is still above +2.5V, so the output of the "red" op amp is "high" and LED2 emits red light.

Battery terminal voltage below +11.6V: At this voltage, the (+) inputs of both op amps are below +2.5V, so both op amp outputs are "low." Therefore, LED 152 does not emit any light.

Resistors R22 and R24 provide positive feedback for the op amps. This causes about +0.1V hysterisis around the switchover points from "green" to "red" to "off," preventing LED 152 from flickering as the battery terminal voltage slowly decreases during use. Capacitor C9 helps prevent any EMI-induced electrical "noise" from affecting the (−) input of the "red" op amp. No capacitor is necessary on the (−) input of the "green" op amp because IC6 effectively does the same thing as capacitor C9, as regards to "noise."

As illustrated in FIG. 10, the ignition transformer of this magneto system shares several similarities with a normal automotive ignition coil. One difference is that the magnetic core structure 196 is a "full core," as contrasted to the more common "I core" used in conventional automotive coils. Primary windings 190 and secondary windings 188 are coaxial, with secondary winding 188 encircling the primary winding. As on a conventional coil, the two ends of the primary winding 190 are connected to the (+) and (−) terminals of the transformer, terminals 132 and 134, respectively.

The (−) terminal 134 is connected to chassis ground during normal operation. One end of secondary winding 188 is connected to a high tension terminal 194, which connects to a center terminal 198 of the distributor cap 28; the other end is connected to the (−)terminal 134 along with one end of the primary winding 190. The windings 188,190 are submerged in a special transformer oil that helps to cool and insulate the winding layers.

The primary and secondary inductance values are much higher than a normal coil; this high inductance, combined with the very high primary currents generated by the magneto generator, produces very high spark energy levels, around 10 times the energy level of a typical automotive ignition. Also contributing to this high output is very low primary and secondary winding resistance.

The "turns ratio," which is the number of turns on the secondary winding 188 for every turn on the primary winding 190, is much less than a normal automotive coil. Preferably, this ratio is in the range of 35:1 to 58:1, compared to 100:1 for a normal automotive coil. This results in somewhat lower ultimate secondary voltage output capability than might otherwise be achieved, but much higher secondary current levels and more efficient energy transfer between the primary and secondary windings. The actual secondary voltage capability is about the same as a normal automotive ignition system. Since the cylinder pressure in these supercharged drag racing engines is actually quite low when the spark is initiated, the secondary voltage required to arc the spark plugs is also fairly low.

The invention has been described with respect to preferred embodiments and applications. Various modifications to the described embodiments can be made by one of ordinary skill in the art without departing from the spirit and scope of the present invention as defined by the appended claims.

What is claimed is:

1. A magneto assembly for an engine, comprising:

a shaft having a polygonal center section with sides defining a plurality of magnet receiving surfaces;

a plurality of magnets, each fixedly mounted to one of the magnet receiving surfaces, with adjacent ones of the magnets being arranged to have alternating outwardly facing poles;

a housing containing an array of stator windings surrounding the plurality of magnets, the housing also including opposed apertures for receiving opposed ends of the shaft; and a ring of non-conductive material sized to surround and retain the plurality of magnets, said ring being positioned between said magnets and said stator windings, wherein said ring is fixedly coupled to said shaft such that said ring rotates with said shaft.

2. The magneto assembly of claim 1, wherein at least one endcap of non-conductive material is constrained for rotation with the shaft, the endcap having interlocking retaining means for mating with corresponding mating means on the ring for preventing axial rotation of the ring relative to the shaft.

3. The magneto assembly of claim 2, wherein an axial end of the polygon center section includes a raised boss having a non-circular shape and an aperture is provided in the at least one endcap that substantially corresponds to the non-circular shape to fix the endcap from rotation relative to the shaft.

4. The magneto assembly of claim 3, wherein the boss is substantially square.

5. The magneto assembly of claim 3, wherein two endcaps are provided, one on each end of the ring.

6. The magneto assembly of claim 5, wherein one of the two endcaps includes a substantially circular aperture that fits over the shaft and does not prevent rotation of the one endcap and the other of the two endcaps includes the non-circular aperture.

7. The magneto assembly of claim 2, wherein one of the ring and at least one endcap includes one or more protrusions on a surface thereof and the other includes one or more slots for receiving the one or more protrusions.

8. The magneto assembly of claim 7, wherein the one or more protrusions and one or more slots are substantially equally spaced about the periphery of the ring and the at least one endcap.

9. The magneto assembly of claim 2, wherein one end of said shaft includes a flattened drive portion for engagement with a magneto driving element.

10. The magneto assembly of claim 9, wherein opposed flattened drive portions are provided.

11. The magneto assembly of claim 1, wherein the center section is octagonal to define eight magnet receiving surfaces.

12. The magneto assembly of claim 1, wherein the plurality of magnets are rare earth magnets.

13. The magneto assembly of claim 1, further comprising two bearings, one being located within each housing aperture, one of the bearings being adjustably retained by a bearing retainer capable of manual axial adjustment relative to the housing so as to provide predetermined shaft freeplay and bearing preload.

14. The magneto assembly of claim 13, wherein one of the housing apertures is threaded and the bearing retainer is threadably retained in the threaded aperture.

15. The magneto assembly of claim 14, wherein fixing means are provided to manually fix the position of the bearing retainer.

16. The magneto assembly of claim 15, wherein the fixing means is one or more set screws.

17. The magneto assembly of claim 14, wherein removal means are provided to adjust the bearing retainer.

18. The magneto assembly of claim 2, wherein remaining space between the ring, the at least one end cap, the magnets and the shaft is filled with a bonding material to rigidly retain the assembly together.

19. The magneto assembly of claim 18, wherein the bonding material is epoxy.

20. The magneto assembly of claim 1, wherein the magnets are radially aligned about the shaft to define an outer periphery of a predetermined radius from a central axis of the shaft, each of the magnets has a substantially same axial length, and the ring is cylindrical with an inner radius substantially the same as the outer periphery of the magnets and a length substantially the same as the magnets so as to closely surround the magnets.

21. The magneto assembly of claim 20, wherein the ring has a thickness of about 1 mm.

22. A magneto assembly for an engine, comprising:

a shaft having a polygonal center section with sides defining a plurality of magnet receiving surfaces;

a plurality of magnets, each fixedly mounted to one of the magnet receiving surfaces, with adjacent ones of the magnets being arranged to have alternating outwardly facing poles;

a housing containing an array of stator windings surrounding the plurality of magnets, the housing also including opposed apertures for receiving opposed ends of the shaft;

a ring of non-conductive material sized to surround and retain the plurality of magnets; and at least one endcap of non-conductive material constrained for rotation with the shaft, the endcap and the ring being provided with interlocking retainers on mating peripheral surfaces thereof for fixing axial rotation of the ring relative to the endcap.

23. A magneto assembly for an engine, comprising:

a shaft having a polygonal center section with sides defining a plurality of magnet receiving surfaces;

a plurality of magnets, each fixedly mounted to one of the magnet receiving surfaces, with adjacent ones of the magnets being arranged to have alternating outwardly facing poles;

a housing containing an array of stator windings surrounding the plurality of magnets, the housing also including opposed apertures for receiving opposed ends of the shaft; and a non-conductive retainer surrounding the plurality of magnets and affixed to the shaft to counteract centrifugal forces acting on the magnets and retain the magnets on the shaft, the non-conductive retainer being located between the magnets and the stator windings and minimizing eddy currents and heat buildup in the magneto assembly.

24. An interlocking non-conductive retaining assembly for a radial array of magnets spaced about a rotating shaft for the support and retention of the magnets, the retaining assembly comprising:

a cylindrical ring having an inner diameter substantially the same as an outer diameter of the radial array of magnets; and an endcap having a central aperture for receiving an end of the shaft, the aperture being of a non-circular configuration matching a drive boss on the shaft, wherein one end of the cylindrical ring includes an interlocking retainer that mates with a corresponding interlocking retainer located on the periphery of the endcap.

25. The interlocking assembly of claim 24, wherein the interlocking retainer on the endcap is one or more projections extending from the endcap.

26. The interlocking assembly of claim 25, wherein the interlocking retainer on the ring is one or more slots formed on one end of the ring and interlockable with the one or more projections.

27. The interlocking assembly of claim 24, wherein the interlocking retainer on the ring is one or more projections extending from the ring.

28. The interlocking assembly of claim 27, wherein the interlocking retainer on the endcap is one or more slots formed on a periphery of the endcap and interlockable with the projections on the ring.

29. An ignition system for an engine, comprising a magneto assembly and a control assembly, the magneto assembly including:

a shaft having a polygonal center section with sides defining a plurality of magnet receiving surfaces;

a plurality of magnets, each fixedly mounted to one of the magnet receiving surfaces, with adjacent ones of the magnets being arranged to have alternating outwardly facing poles;

a housing containing an array of stator windings surrounding the plurality of magnets, the housing also including opposed apertures for receiving opposed ends of the shaft; and a non-conductive retainer surrounding the plurality of magnets and affixed to the shaft to counteract centrifugal forces acting on the magnets and retain the magnets on the shaft, the non-conductive retainer being located between the magnets and the stator windings and minimizing eddy currents and heat buildup in the magneto assembly; and wherein the control assembly includes a control circuit that controls dwell and burn periods of the magneto assembly, the magneto assembly having a generator output current that is rectified to direct current only during dwell periods of operation to cause bipolar spark generation.

30. A magneto assembly for an engine, comprising:

a shaft having a polygonal center section with sides defining a plurality of magnet receiving surfaces; a plurality of magnets, each fixedly mounted to one of the magnet receiving surfaces, with adjacent ones of the magnets being arranged to have alternating outwardly facing poles;

a housing containing an array of stator windings surrounding the plurality of magnets, the housing also including opposed apertures for receiving opposed ends of the shaft;

a non-conductive retainer surrounding the plurality of magnets and affixed to the shaft to counteract centrifugal forces acting on the magnets and retain the magnets on the shaft, the non-conductive retainer being located between the magnets and the stator windings and minimizing eddy currents and heat buildup in the magneto assembly; and a transformer having a primary winding and a secondary winding, said transformer having a turns ratio of the secondary winding to the primary winding of between 35:1 and 58:1.

* * * * *